US008699901B2

(12) United States Patent
Hirayama et al.

(10) Patent No.: US 8,699,901 B2
(45) Date of Patent: Apr. 15, 2014

(54) DEPOSITED TONER MEASURING APPARATUS HAVING A CAPACITOR AND A CAPACITANCE CHANGE DETECTOR FOR DETECTING A CHANGE IN CAPACITANCE OF THE CAPACITOR, AND AN IMAGE FORMATION APPARATUS, AND METHOD FOR CONTROLLING IMAGE FORMATION APPARATUS RELATED THERETO

(75) Inventors: Junya Hirayama, Takarazuka (JP); Toshiya Natsuhara, Takarazuka (JP); Takeshi Maeyama, Ikeda (JP); Shigeo Uetake, Takatsuki (JP); Nofumi Mizumoto, Nara (JP); Makiko Watanabe, Uji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 362 days.

(21) Appl. No.: 13/041,945

(22) Filed: Mar. 7, 2011

(65) Prior Publication Data

US 2011/0222884 A1 Sep. 15, 2011

(30) Foreign Application Priority Data

Mar. 9, 2010 (JP) ..... 2010-051520

(51) Int. Cl.
*G03G 15/08* (2006.01)
*G03G 15/00* (2006.01)

(52) U.S. Cl.
USPC ..... 399/53; 399/49

(58) Field of Classification Search
USPC ..... 399/53, 55, 49, 258, 279, 281, 285
See application file for complete search history.

(56) References Cited

U.S. PATENT DOCUMENTS

| | | | | |
|---|---|---|---|---|
| 6,636,706 | B2 | 10/2003 | Chadani et al. | |
| 6,795,101 | B2 * | 9/2004 | Van Der Meer et al. | 347/142 |
| 2002/0159780 | A1 | 10/2002 | Chadani et al. | |
| 2011/0182605 | A1 * | 7/2011 | Otsuka et al. | 399/55 |

FOREIGN PATENT DOCUMENTS

| | | | | |
|---|---|---|---|---|
| DE | 19643611 | A1 * | 4/1998 | G03G 13/00 |
| JP | 05-150636 | | 6/1993 | |
| JP | 06-258949 | | 9/1994 | |
| JP | 08-015975 | A | 1/1996 | |
| JP | 2000-29255 | A | 1/2000 | |
| JP | 2002-328517 | A | 11/2002 | |
| JP | 2007-57720 | A | 3/2007 | |
| JP | 2008-176236 | | 7/2008 | |

OTHER PUBLICATIONS

Notice of Allowance for Japanese Patent Application No. 2010-051520 mailed Jan. 14, 2014.

* cited by examiner

*Primary Examiner* — Billy Lactaoen
(74) *Attorney, Agent, or Firm* — Brinks Gilson & Lione

(57) ABSTRACT

Provided is a deposited-toner measuring apparatus capable of accurate detection of the amount of toner deposited on the toner carrying member, and an image forming apparatus equipped with the aforementioned measuring apparatus and capable of controlling the amount of toner deposited on the toner carrying member to a desired level so as to provide stable image quality at all times. A deposited-toner measuring apparatus that removes a toner layer in a part of the surface of the toner carrying member, detects change in the capacitance at the portion with a toner layer and the portion without such a toner layer, and detects the amount of the deposited toner based on the detection result of the said change in the capacitance.

19 Claims, 5 Drawing Sheets

DEPOSITED TONER MEASURING APPARATUS HAVING A CAPACITOR AND A CAPACITANCE CHANGE DETECTOR FOR DETECTING A CHANGE IN CAPACITANCE OF THE CAPACITOR, AND AN IMAGE FORMATION APPARATUS, AND METHOD FOR CONTROLLING IMAGE FORMATION APPARATUS RELATED THERETO

This application is based on Japanese Patent Application No. 2010-051520 filed on Mar. 9, 2010, the contents of which are hereby incorporated by reference.

BACKGROUND OF THE INVENTION

1. Field of the Invention

The present invention relates to an image forming apparatus wherein a toner layer is formed on the surface of a toner carrying member and is transported, and the latent image formed on the surface of the image carrier is developed with toner. In particular, the present invention relates to a deposited-toner measuring apparatus and an image forming apparatus for detecting the toner deposited on the toner carrying member when a toner layer is formed.

2. Description of the Background Art

There is extensively used an image forming apparatus using an electrophotographic process in which an electrostatic latent image is formed on a photo conductor (image carrier) and is developed with toner, and the toner image is transferred onto paper or another recording medium to be fixed in position.

As the development methods for developing an electrostatic latent image using a dry type developer includes a one-component development method using toner alone and a two-component development method using both toner and carrier are conventionally known.

There is also a development method capable of ensuring high image quality on the same level as that obtained by the one-component development method, as well as providing a long service life as the two-component development method. This is disclosed as a so-called hybrid development method in which a two-component developer is carried on a developer carrying member and only toner is supplied from the two-component developer to the toner carrying member to per form development (For example, unexamined Japanese Patent Application Publication No. H05 (1993)-150636).

In the hybrid development method, a bias voltage is applied to supply toner from the developer to the toner carrying member. The toner layer formed on this toner carrying member is used to develop the latent image on the image carrier arranged facing the toner carrying member.

In the one-component development method or the hybrid development method, if there is a change in the toner amount (deposited-toner amount) of the toner layer formed on the toner carrying member, the state of image formation is changed, resulting in a change in image density which affects the image quality.

Thus, to get stable image quality, it is important to ensure that the amount of toner deposition on the toner layer formed on the toner carrying member is kept at a constant level. For that purpose, at the time when forming a toner layer on the toner carrying member, it is required to accurately detect the amount of the deposited toner, which fluctuates depending on the printing environment, the total number of printed sheets and/or the number of continuous printing sheets.

As one of the methods for detecting the amount of toner deposited on the toner layer formed on the toner carrying member, an optical detection method is commonly known (Unexamined Japanese Patent Application Publication No. 2008-176236). This method uses an LED or LD as a light emitting section. The emitted light is applied to the toner layer, and the reflected light is detected by a light receiving element such as a photoelectric conversion element, and the absolute amount of the toner layer is obtained from the intensity of this reflected light.

In another method, the electric charge amount of toner supplied from the developer carrying member to the toner carrying member is obtained by analyzing the current flowing through a closed loop circuit made up of a toner carrying member, a developer carrying member and a bias power supply connected therebetween (e.g., Unexamined Japanese Patent Application Publication No. H06 (1994)-258949).

By this method, the charge amount of toner supplied to the toner carrying member can be measured in the actual operation. And based on the measured charge amount, it is possible to control the amount of toner deposited on the toner carrying member to be kept at a constant level.

As described above, to control the formation of the toner layer on the toner carrying member so that stable image quality can be provided, it is necessary to accurately detect the amount of the deposited toner, which fluctuates depending on the printing environment, the total number of printed sheets, and/or the number of continuous printing sheets.

The Unexamined Japanese Patent Application Publication No. 2008-176236 discloses a technique on the optical detecting method for detecting the deposited toner amount of the toner layer formed on the toner carrying member. In this technique, light is applied to the toner layer, and the reflected light is detected by the light receiving element. The amount of toner deposited on the toner layer is obtained from the detection result.

However, this technique is accompanied by the following problem. There are two methods to capture the reflected light, i.e. one method is to capture the scattered light from toner, and the other one is to capture the reflected light from the toner carrying member. However, if the amount of toner deposited on the toner carrying member is excessive, neither method can detect a change in the amount of the deposited toner.

Unexamined Japanese Patent Application Publication No. H06 (1994)-258949 discloses a technique in which the amount of the charged toner supplied to the toner carrying member from the developer carrying member is obtained by analyzing the current flowing through the closed loop circuit including a toner carrying member and a developer carrying member. As the amount of charged toner supplied to the toner carrying member can be measured in the actual operation, it is possible to keep the amount of the toner deposited on the toner carrying member at a constant level.

However, a specific charge of the toner itself depends on the printing environment and/or the total number of printed sheets and the number of continuous printing. Therefore, a desired amount of toner cannot always be obtained even when the control is provided according to the calculated amount of deposition (charge amount of deposited toner). For example, if there is an increase in the specific charge of the toner, the amount of the toner to be deposited on the toner carrying member will be reduced. This will make it difficult to ensure sufficient image density.

SUMMARY OF THE INVENTION

The object of the present invention is to provide a deposited-toner measuring apparatus capable of accurately detecting toner deposited on a toner carrying member, and an image forming apparatus having the aforementioned measuring apparatus and capable of providing a stable image at all times by controlling the amount of toner deposited on the toner carrying member to be at a desired level. Other objects, features and advantages of the present invention will become more apparent upon reading the following detailed description along with the accompanying drawings. It is to be understood, however, that the drawings are designed solely for purposes of illustration and not serve to limit the invention, for which reference should be made to the appended claims.

In view of forgoing, one embodiment according to one aspect of the present invention is a deposited toner measuring apparatus, comprising:

a toner carrying member configured to hold a toner layer on a surface thereof, the surface being configured to move in a prescribed direction;

a toner layer removal mechanism configured to remove the toner layer in a first detection area on the surface of the toner carrying member;

a first electrode provided facing the surface of the toner carrying member so that the first electrode and the surface of the toner carrying member form a first capacitor, in such a position that the first electrode relatively moves, with the movement of the surface of the toner carrying member, from one to the other of positions facing the first detection area and a first reference area which is adjacent to the first detection area in which the toner layer exists; and a capacitance change detector configured to detect a change in capacitance of the first capacitor, the change in capacitance being caused when the first electrode relatively moves from one to the other of the positions facing the first detection area and the first reference area.

According to another aspect of the present invention, another embodiment is a deposited toner amount control apparatus, comprising:

the abovementioned deposited toner measuring apparatus; and a deposition amount control section configured to control an amount of toner to be deposited on the surface of the toner carrying member.

According to another aspect of the present invention, another embodiment is an image formation apparatus, comprising:

an image carrier configured to hold an electrostatic latent image thereon; and a development apparatus configured to develop the latent image with toner, the development apparatus includes:

a toner carrying member provided facing the image carrier, a surface of the toner carrying member configured to move in a prescribed direction and to hold a toner layer on a surface thereof;

a toner layer removal section configured to remove the toner layer in a first detection area on the surface of the toner carrying member;

a first electrode provided facing the surface of the toner carrying member so that the first electrode and the surface of the toner carrying member form a first capacitor, in such a position that the first electrode relatively moves, with the movement of the surface of the toner carrying member, from one to the other of positions facing the first detection area and a first reference area which is adjacent to the first detection area and in which the toner layer exists;

a capacitance change detector configured to detect a change in capacitance of the first capacitor, the change in capacitance being caused when the first electrode relatively moves from one to the other of the positions facing the first detection area and the first reference area; and a deposition amount control section configured to control an amount of toner to be deposited on the surface of the toner carrying member, based on a detection result of the capacitance change detector.

According to another aspect of the present invention, another embodiment is a method for controlling an image formation apparatus including: an image carrier configured to hold an electric latent image thereon; and a development apparatus having a toner carrying member configured to hold a toner layer on a surface thereof so as to develop the electrostatic latent image on the image carrier with the toner layer, the method comprising the steps of:

removing the toner layer in a first detection area on the surface of the toner carrying member;

moving the surface of the toner carrying member in such a manner that a first electrode, which provided facing the toner carrying member so that the first electrode and the surface of the toner carrying member form a first capacitor, relatively moves from one to the other of positions facing the first detection area and a first reference area which is adjacent to the first detection area and in which the toner layer exists;

detecting a change in capacitance of the first capacitor, the change in capacitance being caused when the first electrode relatively moves from one to the other of the positions facing the first detection area and the first reference area; and controlling a toner amount to be deposited on the surface of the toner carrying member, based on the change in capacitance detected in the step of detecting a change in capacitance and based on a correlation between a change in capacitance and a deposited toner amount, the correlation having been measured and stored in advance.

DETAILED DESCRIPTION OF THE PREFERRED EMBODIMENT

Figure 1:
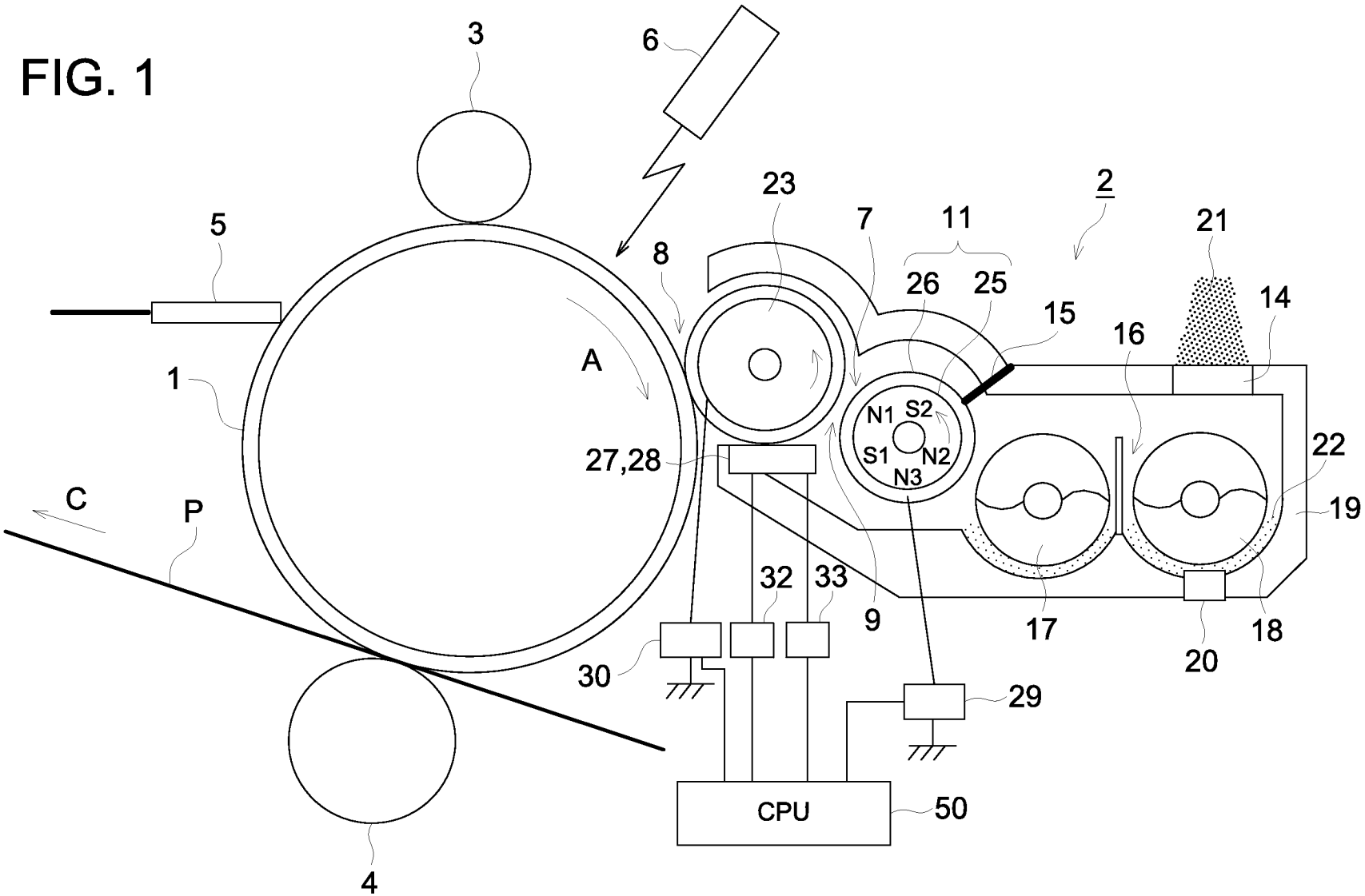
FIG. 1 is a cross sectional view showing an example of the structure of the major components in an image forming apparatus according to a first embodiment of the present invention.

The following describes a first embodiment of the present invention with reference to FIG. 1.

In the following description, an example of an image forming apparatus equipped with a development apparatus based on the hybrid development method. As is obvious, a development method of the present invention should not be restricted to this method. Another development method such as a one-component development method can also be utilized.

(Structure and Operation of an Image Forming Apparatus)

FIG. 1 is a cross sectional view showing an example of the major components in an image forming apparatus according to an embodiment of the present invention. Referring to FIG.

1, the following describes the schematic structure and operation of the image forming apparatus of the present embodiment.

This image forming apparatus is a printer in which a toner image formed on the image carrier (photoreceptor) 1 by the electrophotographic process is transferred onto a transfer medium P such as a paper sheet to form an image thereon.

This image forming apparatus is equipped with an image carrier 1 for carrying an image. Around the image carrier 1 and in the rotating direction A of the image carrier, there are arranged in the following order a charging member 3 for electrically charging the image carrier 1, an exposure device 6 for applying light corresponding to an image to the surface of the charged image carrier 1 so as to form an electrostatic latent image, a development apparatus 2 for developing the electrostatic latent image on the image carrier 1 with toner, a transfer roller 4 for transferring the toner image on the image carrier 1 to the transfer medium P, and a cleaning blade 5 for removing the residual toner from the image carrier 1.

After having been charged by the charging member 3, the image carrier 1 is exposed to light of the exposure device 6 equipped with, for example a laser light-emitting device, and whereby an electrostatic latent image is formed on the surface of the image carrier. The development apparatus 2 develops this electrostatic latent image to form a toner image. After transferring the toner image on the image carrier 1 to the transfer medium P, the transfer roller 4 conveys the transfer medium P in the arrow marked direction C of the drawing.

The toner image on the transfer medium P is fixed by a fixing apparatus (not illustrated), and after that, the transfer medium P is ejected. Subsequent to the transfer, the cleaning blade 5 removes the residual toner from the image carrier 1 by the mechanical force.

A conventional technique of the electrophotographic process can be used as needed, for the image carrier 1, the charging member 3, the exposure device 6, the transfer roller 4, and the cleaning blade 5, etc. used in the image forming apparatus. For example, a charging roller is illustrated as a charging member 3 in the drawing, but instead, it may be a charging device which is not in contact with the image carrier 1. Further, a cleaning blade 5 need not be used.

A structure of the development apparatus 2 will be described later.

(Composition of Developer)

A hybrid development method is used in the present embodiment, and accordingly, an appropriate two-component developer can be used. To be more specific, the developer used in the present embodiment includes toner and carrier for charging the toner.

<Toner>

There is no particular restriction concerning the type of toner to be used. A commonly used toner can be adopted. The binder resin can include colorant and a charge controlling agent or release agent. An external additive can also be added. There is no particular restriction to the particle size of toner, but the preferred size is generally in the range of 3 to 15 μm.

The toner can be produced according to the conventionally-known method. For example, the pulverization method, emulsion polymerization technique, or suspension polymerization technique, etc. can be used to produce the toner.

As binder resin, colorant, charge-controlling agent and release agent to be used for toner, those products commonly known for general use can be used.

The conventionally-known agent can also be used as the aforementioned external additive agent. The opposite polarity particles having the charging polarity opposite to that of the toner can be used as the aforementioned external additive agent.

<Carrier>

There is no particular restriction to the type of carrier to be used. A conventionally-known carrier can be used. A binder type carrier or coated type carrier can be utilized. Further, there is no particular restriction to the particle size of earlier. The preferred particle size is in the range of 15 to 100 μm.

The binder type carrier is obtained by dispersing the magnetic fine particles in binder resin. Positively or negatively charging fine particles can be fixed onto the surface of the carrier, or a surface coating layer can be provided.

Conventionally-known binder resin and magnetic fine particles can be used for the binder type carrier.

In the meantime, the coated type carrier is produced by coating the carrier core particles made of magnetic substances with resin. For the coated type carrier, positively or negatively charging fine particles can be fixed onto the surface of the carrier, similarly to the case of the binder type carrier.

The mixture ratio of the toner and the carrier may be adjusted to get a desired amount of toner charge. The mixture ratio of toner is generally 3 to 50% by mass, preferably 6 to 30% by mass with respect to the total amount of toner and carrier.

(Structure and Operation of Development Apparatus 2)

Referring to FIG. 1, the following describes the details of the structural and operational examples of the development apparatus 2 of the present embodiment.

<Structure of Development Apparatus>

The development apparatus of this embodiment has a toner carrying member, and a developer carrying member for supplying toner to the toner carrying member, and development is performed with the toner layer formed on the toner carrying member facing the image carrier. A plurality of toner carrying member can be used and a plurality of developer carrying members can be used.

As described above, the developer 22 used in the development apparatus 2 is made of toner and carrier, and is stored in a developer reservoir 16.

The developer reservoir 16 is formed of a developing device enclosure 19, and incorporates the mixing and agitating members 17 and 18. The mixing and agitating members 17 and 18 mix and agitate the developer 22, and supply the developer 22 to the developer carrying member 11. An ATDC (Automatic Toner Density Control) sensor 20 for toner density detection is preferably arranged at the position facing the mixing and agitating member 18 in the developer enclosure 19.

The development apparatus 2 has a supply section 14 for supplying the developer reservoir 16 with the same amount of toner as that to be consumed in the development area 8. Toner 21 is fed into the developer reservoir 16 from a hopper (not illustrated) accommodating the toner, through the supply section 14.

The developer carrying member 11 includes a magnetic member 25 fixedly arranged inside and a rotatable sleeve roller 26 including the same. The developer 22 supplied to the developer carrying member 11 is retained on the surface of the sleeve roller 26 by the magnetic force of the magnetic member 25 inside the developer carrying member 11. The developer 22 is conveyed by the rotation of the sleeve roller 26. The amount of the developer 22 to be conveyed is regulated by the regulating member (regulating blade) 15 arranged to be opposed to the developer carrying member 11.

The magnetic member 25 has five magnetic poles N1, S1, N3, N2, and S2 in the rotating direction of the sleeve roller 26.

Of these magnetic poles, the main magnetic pole N1 is arranged in the toner supply area 7 facing the toner carrying member 23. Further, the north poles N2 and N3 having the same polarity for generating the repulsive magnetic field for separating the developer 22 from the sleeve roller 26 are arranged facing the internal side of the developer reservoir 16.

The toner supply bias voltage Vs for supplying the toner carrying member 23 with toner is applied to the developer carrying member 11 by the toner-supply-bias power supply 29 for the developer carrying member.

The toner carrying member 23 is arranged facing both the developer carrying member 11 and the image carrier 1. The development bias voltage for developing the electrostatic latent image on the image carrier 1 is applied from the development bias power supply 30 for the toner carrying member.

<Operation of Development Apparatus>

Similarly, referring to FIG. 1, the following describes the details of the operation example of the development apparatus 2 in the present embodiment.

The developer 22 inside the developer reservoir 16 is mixed and agitated by the rotation of the mixing and agitating members 17 and 18, and is triboelectrically charged. In the meantime, the developer 22 is circulated and conveyed inside the developer reservoir 16, and is supplied to the sleeve roller 26, which is the surface part of the developer carrying member 11.

This developer 22 is retained on the surface of the sleeve roller 26 by the magnetic force of the magnetic member 25 inside the developer carrying member 11, and is conveyed along with the rotation of the sleeve roller 26. The amount of the developer 22 conveyed on the surface of the sleeve roller 26 is regulated by the regulating member 15 opposed to the developer carrying member 11.

The developer 22, having been regulated by the regulating member 15, is conveyed to the toner supply area 7 facing the toner carrying member 23.

In the toner supply area 7 where the toner carrying member 23 and the developer carrying member 11 face each other, the developer 22 is bristled by the main magnetic pole N1 of the magnetic member 25. The toner in the developer 22 is supplied to the toner carrying member 23 by the force applied to the toner by the toner supply electric field formed according to the potential difference between the development bias VB applied to the toner carrying member 23 and the toner supply bias Vs applied to the developer carrying member 11.

The bias VB obtained by superposing an AC voltage to a DC voltage is applied to the toner carrying member 23. The bias Vs obtained by superposing an AC voltage to a DC voltage is also applied to the developer carrying member 11. And the electric field obtained by superposing an AC electric field to a DC electric field is formed in the toner supply area 7.

The toner layer is supplied onto the toner carrying member 23 from the developer carrying member 11 in the toner supply area 7, and is conveyed to the development area 8 by the rotation of the toner carrying member 23, and is supplied for development by the electric field formed by the development bias VB applied to the toner carrying member 23 and the latent image potential on the image carrier 1.

In the development area 8, development is performed by the transfer of toner by the electric field through the development gap provided between the toner carrying member 23 and image carrier 1. After toner has been consumed in the development area 8, the residual toner layer (post-development residual toner layer) which has not been consumed in the development area 8 is conveyed to the toner supply area 7 along with the rotation of the toner carrying member 23.

In the toner supply area 7, the post-development residual toner remaining on the toner carrying member 23 is mechanically scraped off by the developer 22 having been bristled on the developer carrying member 11, and the remaining post-development residual toner is recovered.

The developer 22 having passed through the toner supply area 7 is further conveyed toward the developer reservoir 16 along with the rotation of the sleeve 26, and is separated from the developer carrying member 11 by the repulsive magnetic field generated by the magnetic poles N2 and N3 of the magnetic member 25. Then the developer 22 is recovered into the developer reservoir 16.

When a supply control section (not illustrated) detects from the output value of the ATDC sensor 20 that the toner density in the developer 22 has been reduced below the minimum toner density for ensuring the required image density, the supply toner 21 stored in the hopper is supplied into the developer reservoir 16 through the toner supply section 14 by the toner supply device (not illustrated).

(Detection of the Deposited-Toner Amount on the Toner Carrying Member)

In the development apparatus 2 of the aforementioned structure, it is important to stabilize the amount of the toner deposited on the toner carrying member 23.

If the deposited-toner amount of the toner layer formed on the toner carrying member 23 varies, the state of image formation will be subjected to the change, and a change in image density occurs which will affect the image quality. Thus, to stabilize the image quality, it is important to ensure that the amount of toner deposited on the toner layer formed on the toner carrying member 23 is kept at a constant level. This requires accurate detection of the amount of the deposited toner, which fluctuates depending on the printing environment, the total number of printed sheets and/or the number of continuous printing sheets, when forming a toner layer on the toner carrying member 23.

The deposited-toner measuring apparatus of the present embodiment is designed to ensure high-precision detection of the amount of toner deposited on the toner carrying member 23. Here, "deposited-toner measuring" is defined as measuring any data which is related to the amount of toner, not measuring directly the amount of toner. Based on the result of this measurement, the amount of toner can be determined. Thus, the fluctuation, in the amount of toner supplied from the developer carrying member 11 to the toner carrying member 23, caused by the printing environment, the total number of printed sheets and/or the number of continuous printing sheets can be reduced and a toner layer with stable amount of toner on the toner carrying member 23 is ensured at all times.

<Detection of the Amount of Toner with the Deposited-Toner Measuring Apparatus>

Figure 2:
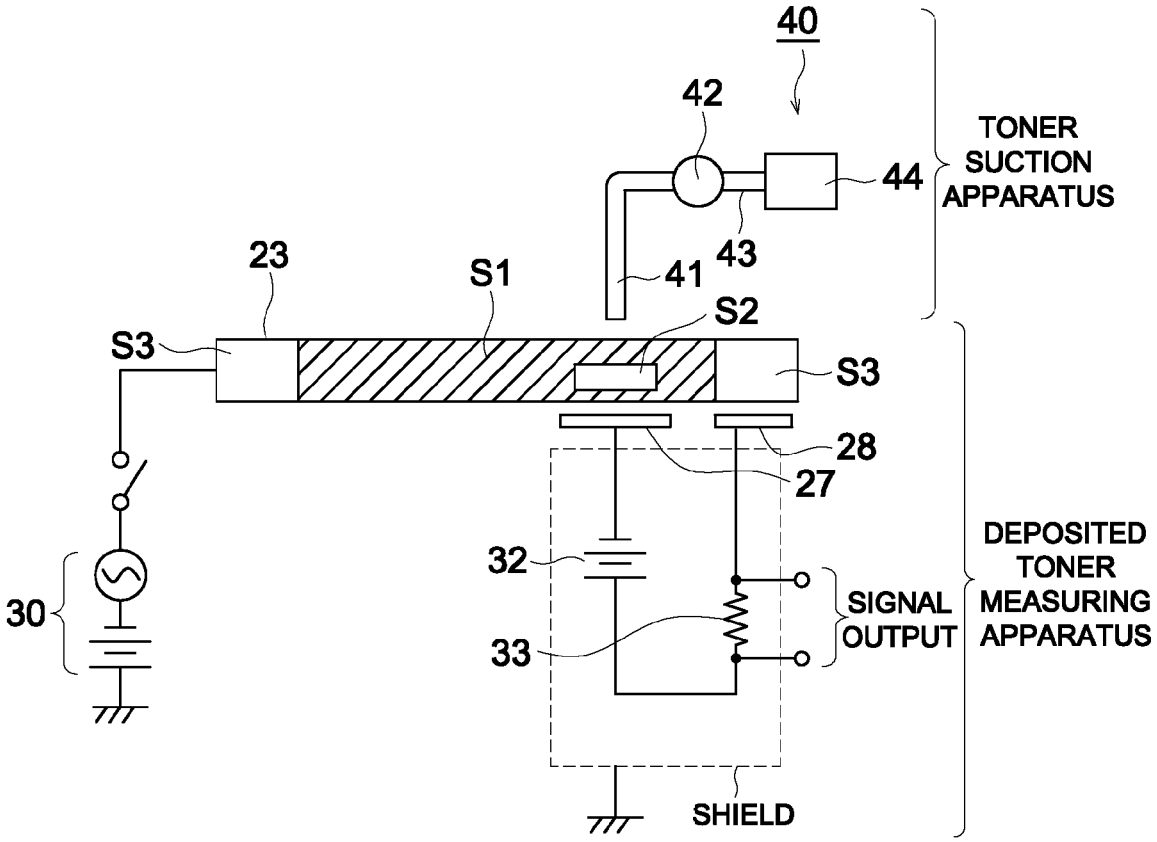
FIG. 2 is a schematic view showing a deposited-toner measuring apparatus and a toner suction apparatus for explaining the principle of detecting the amount of toner on a toner carrying member.

Referring to FIG. 2, the following describes the principle of detecting the amount of toner on the toner carrying member 23. As electrode sections, electrodes 27 and 28 are arranged in the longitudinal direction of the toner carrying member 23 facing the surface of the toner carrying member. The electrode 27 faces the toner deposition region S1 formed on the toner layer on the toner carrying member, and the electrode 28 faces the region S3 where a toner layer is not formed. The electrode 27 and the electrode 28 are serially connected having the conductive substrate of the toner carrying member therebetween, and the DC power supply 32, the sense resistor 33, and these two electrodes 27 and 28 constitute a closed circuit. Further, this closed circuit is covered by a shield to block the external induction noise.

In the present embodiment, a negatively charged toner is used. Thus, the negative side of the DC power supply 32 is connected to the electrode 27 to prevent toner from sticking to the electrode 27.

To form a toner deposition region S1 where a uniform toner layer is formed on the toner carrying member 23, the developer carrying member 11 carrying the two-component developer and the toner carrying member 23 are arranged facing each other with prescribed space intervals. By applying a bias voltage between the developer carrying member 11 and the toner carrying member 23, a toner deposition region is formed on the surface of the toner carrying member 23. In this case, the amount of the deposited toner can be changed by adjusting the bias voltage.

A part of the toner layer, which was formed on the surface of the toner carrying member 23 as explained above, is removed by a suction nozzle 41 of the toner suction apparatus 40 together with air, whereby the region S2 free of toner is produced.

Figure 3:
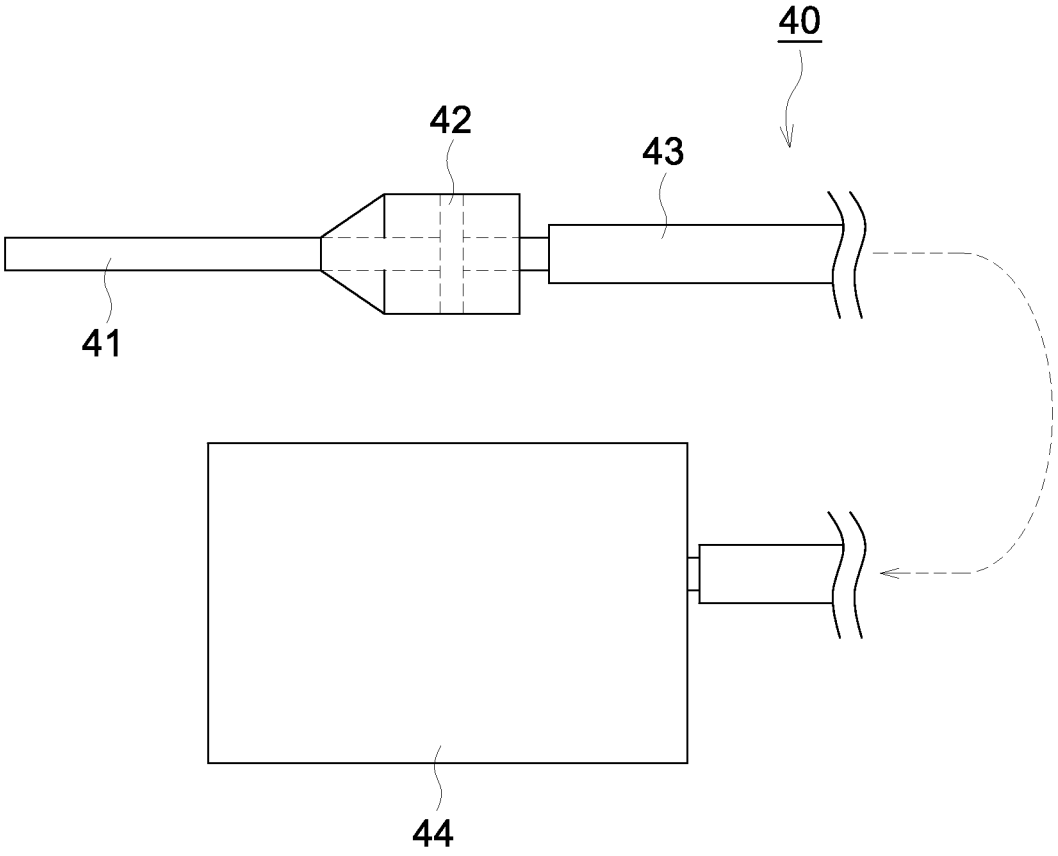
FIG. 3 is a schematic explanatory diagram showing a toner suction apparatus.

FIG. 3 is a schematic explanatory diagram of the toner suction apparatus 40. The toner suction apparatus 40 includes a glass suction nozzle 41, a suction air pump 44, and a resin tube 43 for connecting the suction nozzle 41 and the suction air pump 44. A toner capturing filter 42 for capturing the sucked toner particles is attached on the suction nozzle. From the area of the region S2 from which toner has been removed by the toner suction apparatus 40 and a change in the weight of the toner capturing filter 42 between before and after suction, the amount of toner deposition (amount of toner per unit area) on the surface of the toner carrying member 23 can be calculated in advance.

Going back to FIG. 2, the toner carrying member 23 having the region S2 free of toner is rotated in such a way that the boundary between the region with the toner layer (S1) and the region without the same (S2) passes through the portion facing the electrode 27. When passing through that portion, a charge/discharge current flows in the closed circuit according to a change in the capacitance between the region with the toner layer (S1) and region without the same (S2) when the boundary thereof passes through the portion facing the electrode 27. The capacitance change detection section, which is constituted by the DC power supply 32, the sense resistor 33 and the circuit connecting them to the electrodes 27 and 28, detects the voltage across the resistor when the charge/discharge current flows in the sense resistor 33. The detected voltage is preferably amplified by the differential amplifier at the following stage. At the time of detecting the charge/discharge current, the development bias power supply is preferably turned of (in a floating state) to reduce the noise caused by a change in the contact state between the toner carrying member and the electric supply line from the development bias power supply.

In the aforementioned manner, the charge/discharge current generated by the passing of the boundary between the region with and without toner (boundary between the S1 and S2) can be measured as the voltage across the sense resistor. The current i(t) obtained from the voltage across the resistor can be approximately expressed by $i(t)=\Delta C \cdot V/\Delta t$, where a change in capacitance is $\Delta C$, the boundary transit time is $\Delta t$, and the power supply voltage is V. This current i(t) is associated with a change in the amount of toner which lies between the toner carrying member and electrode.

Thus, to calculate the amount of toner deposited on the toner carrying member from the detection result of the capacitance change detecting section, the following arrangement may be made. A table is made in advance storing the relationship between the different amounts of toner deposited on the toner carrying member 23 and the corresponding currents i (t) (or the voltages generated across the sense resistor 33) measured according to the aforementioned manner, where the bias voltage between the developer carrying member 11 and the toner carrying member 23 is varied to deposit different amounts of toner on the toner carrying member 23. Then, an unknown deposited-toner amount on the toner carrying member is calculated by comparing the table and the detection result, of the toner carrying member which is deposited with unknown amount of toner, detected by the capacitance change detection section.

The procedure described so far refers to the step for obtaining the correlation between the change in capacitance and the amount of toner in advance, and this step is taken when an image forming apparatus is manufactured or adjusted. The following describes the control procedure in the operation of the image forming apparatus.

<Control to Stabilize the Amount of Toner>

Referring to FIG. 1, the following describes the procedure of detecting the amount of toner deposited on the toner carrying member 23 during the operation of the image forming apparatus, and the control procedure for stabilizing the amount of toner.

The developer carrying member 11 is connected with the toner-supply-bias power supply 29 which applies a bias voltage, in order to supply toner to the toner carrying member 23. This power supply can be a DC power supply, or an AC voltage can be superimposed on the DC voltage.

The suspension of an output from the toner-supply-bias power supply 29 or change of the DC bias level is controlled by a signal from the voltage control section (CPU) 50.

Accordingly, the amount of toner supplied from the developer carrying member 11 to the toner carrying member 23 is controlled by the signal from the voltage control section (CPU) 50.

The development bias power supply 30 which applies the bias voltage for developing the latent image on the image carrier 1 is connected to the toner carrying member 23. This bias voltage is used to adjust the density. This voltage is also related to the difference in potential between the toner carrying member 23 and the developer carrying member 11, namely, the amount of the toner to be supplied. Thus, this bias voltage also requires to be controlled by the voltage control section (CPU) 50.

Figure 4:
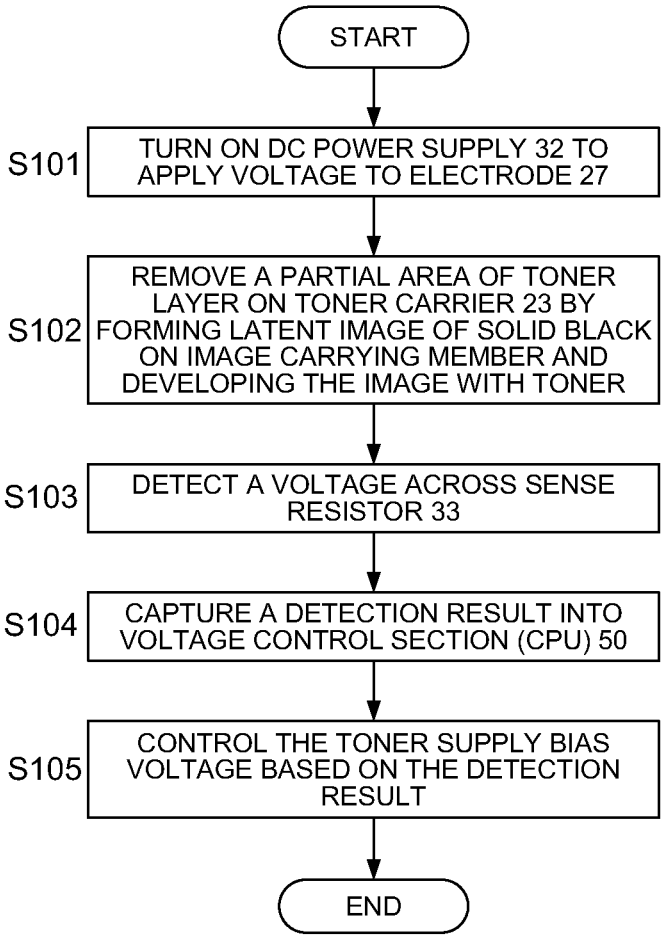
FIG. 4 is a flow chart explaining the deposited toner amount control sequence.

Referring to FIGS. 1, 2, and a flow chart of FIG. 4, the following describes the procedure for controlling the amount of the deposited toner during the operation of the image forming apparatus.

When the development apparatus 2 starts operation, the toner carrying member 23 and the developer carrying member 11 also start rotations, and the development bias voltage and the toner supply bias voltage are applied. A toner layer is continuously formed on the toner carrying member 23 until the end of printing.

The volume control sequence for the toner deposited on the toner carrying member 23 operates during the time that development is not performed by the toner carrying member 23, for example, before or after printing, or between paper feeding during printing.

The following shows an example of operating the deposited toner volume control sequence for the toner deposited on the toner carrying member 23 during the time between termination of printing and termination of the supply of toner to the toner carrying member 23.

<Deposited Toner Volume Control Sequence>

Step S101: At the time that printing is completed, the development bias voltage and toner supply bias voltage are still being applied to the toner carrying member 23 and developer carrying member 11, and formation of a toner layer continues. Under this condition, the DC power supply 32 is turned on in response to the instruction from the voltage control device (CPU) 50 so that voltage is applied to the electrode 27.

Step S102: This is a step of removing a partial area of the toner layer formed on the toner carrying member 23. In the aforementioned process of obtaining the correlation between the current or the voltage associated with a change in the capacitance and the amount of toner, the toner suction apparatus is used. But in this Step S102, the following process is performed under the control of the CPU 50 to remove the toner layer in a partial area on the surface of the toner carrying member 23. A solid black latent image is formed in a prescribed area on the image carrier 1 by using the charging member 3 and the exposure device 6, and then that latent image is developed with the toner on the toner carrying member 23.

Step S103: The voltage across the sense resistor 33 is detected when the boundary between the portions (S1) and (S2) with and without toner, respectively, on the toner carrying member 23 is passing through the position facing the electrode 27. The on/off control of the DC power supply 32 is controlled by the signal from the voltage control section (CPU) 50 so as to detect the change in capacitance which depends on the change in the deposited-toner amount in the closed circuit including the electrodes 27 and 28 and the toner carrying member 23.

Step S104: The data on the voltage across the resistor detected in the aforementioned Step S103 is captured into the voltage control section (CPU) 50.

Step S105: The voltage control section (CPU) 50 refers to the captured detection result and the table that has been created and stored in advance in which the deposited-toner amount and the voltage across the resistor are correlated. If the amount of the deposited toner has been determined to be out of a prescribed range, the voltage control section (CPU) 50 controls the toner supply bias voltage for the developer carrying member 11 so that the deposited-toner amount is kept within the prescribed range.

In another aspect of the embodiment, the table to be stored in advance may not include the relationship between the voltage across the sense register and the deposited-toner amount, but may include the relationship between the voltage across the sense register and the change in capacitance corresponding to the target deposited-toner amount. Further, in order to adjust a toner amount closer to an appropriate value, the control of the voltage may be repeated with the voltage changed by a prescribed value.

Further, the amount of toner supplied to the toner carrying member 23 can be modified by changing the rotation speed of the developer carrying member 11. For example, a possible control is such that if the amount of toner on the toner carrying member 23 is smaller than the specified amount, the rotation speed of the developer carrying member 11 is increased.

Figure 5:
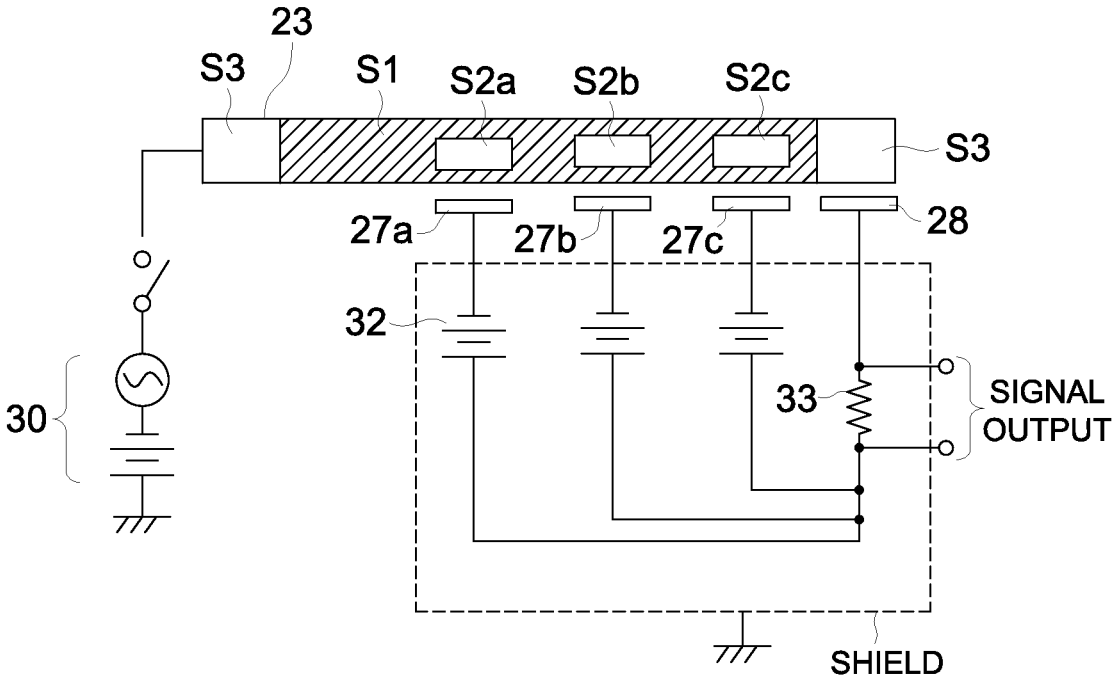
FIG. 5 is a schematic view showing the case where a plurality of toner eliminating positions are provided on the toner carrying member.

Further, the voltage across the resistor can be detected at a plurality of regions on the surface of the toner carrying member, in the Step S103, and the average or the sum total can be calculated. FIG. 5 shows that electrodes 27*a*, 27*b*, and 27*c* are arranged at a plurality of positions, where electrodes 27*a*, 27*b*, and 27*c* are the same as the electrode 27 described with reference to FIG. 2. It also shows that a plurality of positions S2*a*, S2*b*, and S2*c* are provided on the toner carrying member, in each of which positions toner has been removed. The positions S2*a*, S2*b*, and S2*c*, where toner has been removed, are formed so that they pass through the portions facing the electrodes 27*a*, 27*b*, and 27*c*, respectively. When this configuration is used to perform detection, it is possible to even out the variation in the detected result depending on differences in the position of detection, such as the central portion and ends of the toner carrying member.

The electrode 28 is provided facing the region on the toner carrying member, where the toner layer does not exist. However, the electrode 28 may be provided facing a region on the toner carrying member where the toner layer exists, and in that case the present embodiment operates in the same way as described above.

The present inventors mounted the deposited-toner measuring apparatus of FIG. 2 on the image forming apparatus of FIG. 1, and checked the operation. The following describes the details and results.

<Conditions of the Development Apparatus>

In the operation check, the bizhub C350, an MFP manufactured by Konica Minolta Business Technology Co., Ltd. was modified and used as an image forming apparatus, and the development apparatus having the configuration shown in FIG. 1 was mounted on this image forming apparatus. The developer for the aforementioned bizhub C350 was used. The toner was negatively charged and the toner concentration of the developer was 8%. The development gap between the image carrier 1 and the toner carrying member 23 was set at 0.15 mm. The gap between the toner carrying member 23 and the developer carrying member 11 was set at 0.6 mm. The voltage applied to the toner carrying member 23 was a rectangular wave voltage having the peak-to-peak amplitude of 1.4 kV, a DC component of −200V, a frequency of 4 kHz, and a duty ratio of 50%. The velocity ratio of the toner carrying member 23 with respect to the image carrier 1 was 1.5. The velocity ratio of the developer carrying member 11 with respect to the toner carrying member 23 was 1.5. The area of the electrode portion of the deposited-toner measuring apparatus was set at 1 $cm^2$ for both the electrodes 27 and 28, and the distance between the electrode portion and toner carrying member 23 was set at 0.2 mm. Further, the DC power supply 32 used to measure the amount of the deposited toner was set at 960V.

<Measuring the Relationship Between the Bias Applied to the Developer Carrying Member and the Amount of the Deposited Toner>

In order to store, in advance, the relationship between the amount of the toner deposited on the toner carrying member 23 and the charge/discharge current detected by the deposited-toner amount measuring apparatus, with the toner removed in a part of the toner carrying member 23, the bias voltage (DC component alone) applied to the developer carrying member 11 was varied to four levels, and the charge/discharge current for each of the for levels was detected by the deposited-toner measuring apparatus.

The measurement was conducted using the toner suction apparatus shown in FIG. 3, where the amount of the toner deposited on the toner carrying member 23 was measured for each of the four levels of bias applied to the developer carrying member 11, and the voltage occurring across the sense resister was measured when the deposited toner on the prescribed region has been removed by the toner suction apparatus. More specifically, after the bias of each level given in Table 1 was applied to the developer carrying member 11 to form a toner layer on the toner carrying member 23, the development apparatus 2 was stopped, and the toner carrying member 23 was taken out of the development apparatus 2. A toner layer in the prescribed region on the toner carrying member 23 was sucked by the toner suction apparatus. The weight of suction portion of the toner suction apparatus was measured with an electronic balance, and the result was compared with the weight prior to the suction. The amount of the deposited toner was determined based on the increase of the weight.

Table 1 shows the levels of the bias voltage applied to the developer carrying member 11, the measurement results of the amount of toner deposited on the toner carrying member 23, and the measurement results of the voltage coming out across the sense resistor 33.

TABLE 1

| Developer carrying member bias (V) | Amount of the deposited toner ($g/m^2$) | Voltage across the sense resistor (mV) |
|---|---|---|
| −250 | 1.2 | 0.02 |
| −300 | 2.1 | 0.04 |
| −350 | 3.5 | 0.06 |
| −400 | 4.2 | 0.09 |

Figure 6:
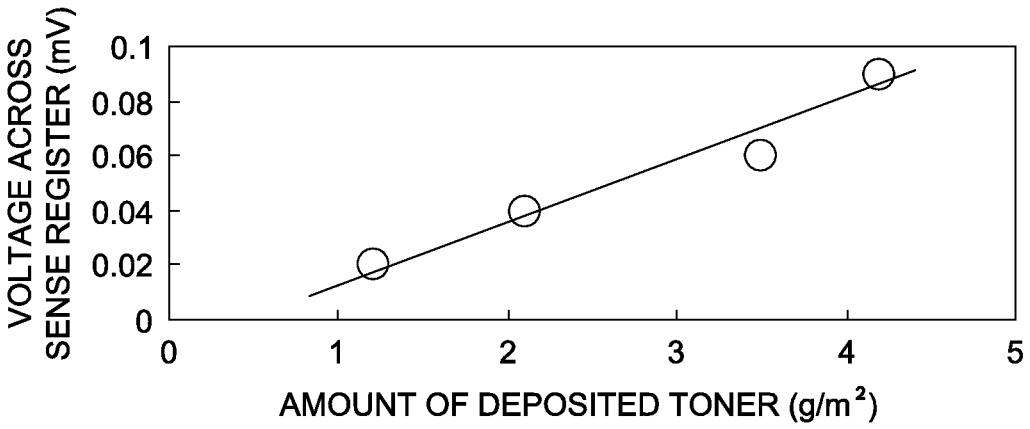
FIG. 6 is a diagram representing the relationship between the amount of toner deposited on the toner carrying member and a voltage generated across the sense resistor.

The relationship, shown Table 1, between the amount of the toner deposited on the toner carrying member 23 and the voltage occurring across the sense resistor 33 is also shown in FIG. 6. As indicated in FIG. 6 the correlation can be confirmed between the voltage (charge/discharge current value) across the sense resistor obtained for the four different bias voltages on the developer carrying member 11, and the amount of the toner deposited on the toner carrying member 23.

The relationship of FIG. 6 was stored in the CPU 50 in the form of a table, and the power supply of the image forming apparatus was turned on in a normal environment (with a temperature of 20° C. and a relative humidity of 50%) and a low-humidity environment (with a temperature of 20 degrees Celsius and a relative humidity of 15%), while the aforementioned deposited toner amount control sequence was operated, and then the toner supply bias voltage of the developer carrying member 11 was controlled to ensure that the amount of the toner deposited on the toner carrying member would be 3.5 $g/m^2$. After that, a solid black image was formed and the image density was measured. The image density was 1.6 in the normal environment, and was 1.4 in the low-humidity environment. Only a slight change was observed in the image density and the positive results were obtained.

In a comparative example, an image was formed under the same conditions as those of the aforementioned example except that a deposited-toner measuring apparatus was not provided. The image density was 1.6 in the normal environment and was 1.0 in the low-humidity environment. The deterioration in image quality owing to the considerable change in image density was observed.

By using the deposited-toner measuring apparatus of the present embodiment, it is possible to more precisely detect the deposited-toner amount without fail, because the deposited-toner amount is detected based on a change in the capacitance between the region with a toner layer attached to the surface of the toner carrying member and the region without such a toner layer, and this technique ensures accurate detection of toner amount, being little affected by the fluctuation in the specific charge of toner due to the printing environment, the total number of printed sheets and/or the number of continuous printing sheets. Further, this technique provides an image forming apparatus that allows easy control to be performed in such a way that the amount of the deposited toner on the toner carrying member reaches a desired level, based on the detection result. Thus, stable image quality can be provided at all times.

The present invention has been appropriately and sufficiently described above to be expressed by way of embodiments with reference to the drawings, but it should be appreciated that a person skilled in the art can easily modify and/or improve the above embodiments. Accordingly, a modified embodiment or improved embodiment carried out by the person skilled in the art should be interpreted to be embraced by the scope as claimed unless departing from the scope as claimed.

What is claimed is:

1. A deposited toner measuring apparatus, comprising:

a toner carrying member configured to hold a toner layer on a surface thereof, the surface being configured to move in a prescribed direction;

a toner layer removal mechanism configured to remove the toner layer in a first detection area on the surface of the toner carrying member;

a first electrode provided facing the surface of the toner carrying member so that the first electrode and the surface of the toner carrying member form a first capacitor, in such a position that the first electrode relatively moves, with the movement of the surface of the toner carrying member, from one to the other of positions facing the first detection area and a first reference area which is adjacent to the first detection area in which the toner layer exists; and a capacitance change detector configured to detect a change in capacitance of the first capacitor, the change in capacitance being caused when the first electrode relatively moves from one to the other of the positions facing the first detection area and the first reference area.

2. The deposited toner measuring apparatus of claim 1, wherein the deposited toner measuring apparatus is to be used in combination with an image carrier for carrying an electrostatic latent image formed thereon, and the toner layer removal mechanism removes the toner layer in the first detection area on the toner carrying member by developing an electrostatic latent image, corresponding to the first detection area, on the image carrier with the toner layer on the surface of the toner carrying member.

3. The deposited toner measuring apparatus of claim 2, wherein the first electrode is constituted by a plurality of second electrodes, the first capacitor is constituted by a plurality of second capacitors which are formed by the plurality of second electrodes and the surface of the toner carrying member, and the capacitance change detector detects an average or a total sum of changes in capacitances of the plurality of second capacitors as the change in capacitance of the first capacitor.

4. The deposited toner measuring apparatus of claim 1, wherein the first electrode is constituted by a plurality of second electrodes, the first capacitor is constituted by a plurality of second capacitors which are formed by the plurality of second electrodes and the surface of the toner carrying member, and the capacitance change detector detects an average or a total sum of changes in capacitances of the plurality of second electrodes as the change in capacitance of the first capacitor.

5. The deposited toner measuring apparatus of claim 1, comprising: a toner amount detector configured to detect a toner amount of the toner layer on the surface of the toner carrying member based on a detection result of the capacitance change detector.

6. The deposited toner measuring apparatus of claim 5, wherein the deposited toner measuring apparatus is to be used in combination with an image carrier for carrying an electrostatic latent image formed thereon, and the toner layer removal mechanism removes the toner layer in the first detection area on the toner carrying member by developing an electrostatic latent image, corresponding to the first detection area, on the image carrier with the toner layer on the surface of the toner carrying member.

7. The deposited toner measuring apparatus of claim 6, wherein the first electrode is constituted by a plurality of second electrodes, the first capacitor is constituted by a plurality of second capacitors which are formed by the plurality of second electrodes and the surface of the toner carrying member, and the capacitance change detector detects an average or a total sum of changes in capacitances of the plurality of second capacitors as the change in capacitance of the first capacitor.

8. The deposited toner measuring apparatus of claim 5, wherein the first electrode is constituted by a plurality of second electrodes, the first capacitor is constituted by a plurality of second capacitors which are formed by the plurality of second electrodes and the surface of the toner carrying member, and the capacitance change detector detects an average or a total sum of changes in capacitances of the plurality of second capacitors as the change in capacitance of the first capacitor.

9. A deposited toner amount control apparatus, comprising: The deposited toner measuring apparatus of claim 1; and a deposition amount control section configured to control an amount of toner to be deposited on the surface of the toner carrying member.

10. An image formation apparatus, comprising:

an image carrier configured to hold an electrostatic latent image thereon; and a development apparatus configured to develop the latent image with toner, the development apparatus includes:

a toner carrying member provided facing the image carrier, a surface of the toner carrying member configured to move in a prescribed direction and to hold a toner layer on a surface thereof;

a toner layer removal section configured to remove the toner layer in a first detection area on the surface of the toner carrying member;

a first electrode provided facing the surface of the toner carrying member so that the first electrode and the surface of the toner carrying member form a first capacitor, in such a position that the first electrode relatively moves, with the movement of the surface of the toner carrying member, from one to the other of positions facing the first detection area and a first reference area which is adjacent to the first detection area and in which the toner layer exists;

a capacitance change detector configured to detect a change in capacitance of the first capacitor, the change in capacitance being caused when the first electrode relatively moves from one to the other of the positions facing the first detection area and the first reference area; and a deposition amount control section configured to control an amount of toner to be deposited on the surface of the toner carrying member, based on a detection result of the capacitance change detector.

11. The image formation apparatus of claim 10, wherein the toner layer removal section removes the toner layer in the first detection area on the surface of the toner carrying member by developing an electrostatic latent image, corresponding to the first detection area, on the image carrier with the toner layer on the surface of the toner carrying member.

12. The image formation apparatus of claim 11, wherein the first electrode is constituted by a plurality of second electrodes, the first capacitor is constituted by a plurality of second capacitors which are formed by the plurality of second electrodes and the surface of the toner carrying member, and the capacitance change detector detects an average or a total sum of changes in capacitances of the plurality of second capacitors as the change in capacitance of the first capacitor.

13. The image formation apparatus of claim 10, wherein the first electrode is constituted by a plurality of second electrodes, the first capacitor is constituted by a plurality of second capacitors which are formed by the plurality of second electrodes and the surface of the toner carrying member, and the capacitance change detector detects an average or a total sum of changes in capacitances of the plurality of second capacitors as the change in capacitance of the first capacitor.

14. The image for nation apparatus of claim 10, comprising: a toner amount detector configured to detect a toner amount of the toner layer on the surface of the toner carrying member based on a detection result of the capacitance change detector, wherein the deposition amount control section controls an amount of the toner to be deposited on the surface of the toner carrying member, based on the toner amount detected by the toner amount detector.

15. The image formation apparatus of claim 14, wherein the toner layer removal section removes the toner layer in the first detection area on the toner carrying member by developing an electrostatic latent image, corresponding to the first detection area, on the image carrier with the toner layer on the surface of the toner carrying member.

16. The image formation apparatus of claim 14, wherein the first electrode is constituted by a plurality of second electrodes, the first capacitor is constituted by a plurality of second capacitors which are formed by the plurality of second electrodes and the surface of the toner carrying member, and the capacitance change detector detects an average or a total sum of changes in capacitances of the plurality of second capacitors as the change in capacitance of the first capacitor.

17. The image formation apparatus of claim 15, wherein the first electrode is constituted by a plurality of second electrodes, the first capacitor is constituted by a plurality of second capacitors which are formed by the plurality of second electrodes and the urface of the toner carrying member, and the capacitance change detector detects an average or a total sum of changes in capacitances of the plurality of second capacitors as the change in capacitance of the first capacitor.

18. A method for controlling an image formation apparatus including: an image carrier configured to hold an electric latent image thereon; and a development apparatus having a toner carrying member configured to hold a toner layer on a surface thereof so as to develop the electrostatic latent image on the image carrier with the toner layer, the method comprising the steps of:

removing the toner layer in a first detection area on the surface of the toner carrying member, moving the surface of the toner carrying member in such a manner that a first electrode, which provided facing the toner carrying member so that the first electrode and the surface of the toner carrying member form a first capacitor, relatively moves from one to the other of positions facing the first detection area and a first reference area which is adjacent to the first detection area and in which the toner layer exists;

detecting a change in capacitance of the first capacitor, the change in capacitance being caused when the first electrode relatively moves from one to the other of the positions facing the first detection area and the first reference area; and controlling a toner amount to be deposited on the surface of the toner carrying member, based on the change in capacitance detected in the step of detecting a change in capacitance and based on a correlation between a change in capacitance and a deposited toner amount, the correlation having been measured and stored in advance.

19. The method of claim 18, wherein the first electrode is constituted by a plurality of second electrodes, the first capacitor is constituted by a plurality of second capacitors which are formed by the plurality of second electrodes and the surface of the toner carrying member, and in the step of detecting a change in capacitance, an average or a total sum of changes in capacitances of the plurality of second capacitors is detected as the change in capacitance of the first capacitor.

* * * * *

UNITED STATES PATENT AND TRADEMARK OFFICE

CERTIFICATE OF CORRECTION

PATENT NO. : 8,699,901 B2
APPLICATION NO. : 13/041945
DATED : April 15, 2014
INVENTOR(S) : Junya Hirayama et al.

It is certified that error appears in the above-identified patent and that said Letters Patent is hereby corrected as shown below:

In the Claims

In column 16, claim 17, line 42, after "electrodes and the" replace "urface" with --surface--.

Signed and Sealed this
Second Day of September, 2014

Michelle K. Lee

Michelle K. Lee
*Deputy Director of the United States Patent and Trademark Office*